US006631790B2

(12) United States Patent
Mattlar et al.

(10) Patent No.: US 6,631,790 B2
(45) Date of Patent: Oct. 14, 2003

(54) METHOD FOR BRAKING A TRACTION SHEAVE ELEVATOR, TRACTION SHEAVE ELEVATOR AND USE OF AN EMERGENCY POWER SUPPLY

(75) Inventors: Seppo Mattlar, Helsinki (FI); Petteri Valjus, Helsinki (FI); Johannes De Jong, Jarvenpaa (FI)

(73) Assignee: Kone Corp., Helsinki (FI)

( * ) Notice: Subject to any disclaimer, the term of this patent is extended or adjusted under 35 U.S.C. 154(b) by 0 days.

(21) Appl. No.: 10/090,782

(22) Filed: Mar. 6, 2002

(65) Prior Publication Data

US 2002/0125079 A1 Sep. 12, 2002

Related U.S. Application Data

(63) Continuation of application No. PCT/FI00/00783, filed on Sep. 15, 2000.

(51) Int. Cl.[7] ..... B66B 5/18

(52) U.S. Cl. ..... 187/375; 187/288; 187/350

(58) Field of Search ..... 187/350, 375, 187/406, 288

(56) References Cited

U.S. PATENT DOCUMENTS

| | | | | |
|---|---|---|---|---|
| 1,934,508 A | * | 11/1933 | McCormick | 187/350 |
| 2,581,297 A | * | 1/1952 | Rissler | 187/350 |
| 4,928,796 A | * | 5/1990 | Poon | 187/89 |
| 5,052,523 A | * | 10/1991 | Ericson | 187/89 |
| 5,323,877 A | * | 6/1994 | Mori | 187/91 |
| 5,323,878 A | | 6/1994 | Nakamura et al. | |
| 5,366,044 A | | 11/1994 | Jamieson et al. | |
| 5,377,788 A | | 1/1995 | Biewald et al. | |

FOREIGN PATENT DOCUMENTS

| | | | | |
|---|---|---|---|---|
| DE | 197 54 034 A1 | | 6/1999 | |
| EP | 856485 | * | 8/1998 | |
| GB | 2 212 782 A | | 8/1989 | |
| JP | 72452 | * | 1/1995 | |
| JP | 7157232 | * | 6/1995 | 187/350 |

* cited by examiner

*Primary Examiner*—Steven A. Bratlie
(74) *Attorney, Agent, or Firm*—Birch, Stewart, Kolasch & Birch, LLP

(57) ABSTRACT

A method for braking a traction sheave elevator stops the elevator in the event of an emergency by the braking of the elevator using a braking device not comprised in the drive machine. A traction sheave elevator is provided with a braking device not comprised in the drive machine and designed to improve the efficiency of emergency stopping. The maximum force decelerating the elevator and generated by the braking device equals about half the weight of the nominal load of the elevator.

13 Claims, 3 Drawing Sheets

METHOD FOR BRAKING A TRACTION SHEAVE ELEVATOR, TRACTION SHEAVE ELEVATOR AND USE OF AN EMERGENCY POWER SUPPLY

This application is a Continuation of copending PCT International Application No. PCT/FI00/00783 filed on Sep. 15, 2000, which was published in English and which designated the United States and on which priority is claimed under 35 U.S.C. §120, the entire contents of which are hereby incorporated by reference.

BACKGROUND OF THE INVENTION

The present invention relates to a method for braking a traction sheave elevator, to a traction sheave elevator and to the use of an emergency power supply.

DESCRIPTION OF THE BACKGROUND ART

The machine of a traction sheave elevator consists of a traction sheave with the elevator hoisting ropes fitted to its grooves and an electric motor driving the traction sheave either directly or via a gear. The machine is provided with a brake, which applies a braking force to the traction sheave either directly or e.g. via the shaft. The operating brake of the elevator works under positive control such that the brake is always braking when it is not specifically caused by the control system not to brake. In a typical operating brake construction, the brake is closed by the force of a spring or an equivalent element, and a controllable actuator counteracting the closing element releases the brake and keeps it released. When braking is applied to the traction sheave, the braking effect is transmitted further to the elevator ropes by the action of the frictional grip and other gripping forces applied by the traction sheave to the ropes. In an emergency braking situation where the elevator is stopped as quickly as possible, a greater gripping force is likely to be needed than when the elevator is being accelerated and decelerated during normal operation.

To improve the grip between the ropes and the traction sheave, the grooves on the traction sheave of especially fast elevators and elevators with a large hoisting height are sometimes heavily undercut. The grip can also be improved by increasing the rope angle. Solutions increasing the rope angle are e.g. ESW (extended single wrap) and double-wrap suspension arrangements, in which crosswise roping or a secondary rope pulley is used to achieve a contact angle larger than 180 degrees between the ropes and the traction sheave. In conventional single-wrap suspension (CSW), the contact angle between the ropes and the traction sheave is 180° or somewhat less if the distance between the ropes is increased using a diverting pulley. Thus, both undercut rope grooves and increasing the undercut as well as increasing the contact angle improve the grip.

For normal operation, in most elevators, including high-rise and fast elevators, conventional single-wrap suspension with the hoisting ropes only passing over the traction sheave and a very moderate undercut in the grooves of the traction sheave would be sufficient to guarantee a non-slip grip between the traction sheave and the ropes with all elevator load alternatives. However, to provide for emergency braking, the system has to be designed so as to ensure a better grip. Improving the grip, however, leads to drawbacks that increase the costs of the elevator, especially the costs arising during operation. An undercut promotes wear of the rope and the rope groove; the larger the undercut, the faster the wear. Similarly, in ESW and double-wrap suspension, rope bends following each other at short distances increase rope wear. In ESW and double-wrap suspension, rope skew is another factor increasing rope wear. Double-wrap suspension produces a particularly hard strain on the bearings of the traction sheave and the secondary rope pulley.

On the other hand, a point to remember is that emergency braking must not be too effective. If the braking is too effective, the rapid deceleration of the elevator car may involve a danger to the passengers. A deceleration rate exceeding gravitational acceleration during upward travel of the elevator is sufficient for the passengers to loose contact with the floor of the elevator car. Depending on the initial deceleration rate, this will cause the passengers to be hurled against the ceiling of the elevator car or at least to tumble.

SUMMARY OF THE INVENTION

The object of the invention is to remedy the above-mentioned defects and at the same time to extend the use of conventional elevator suspension based on an advantageous fundamental solution to elevators designed for higher speeds or a greater hoisting height. Another object of the invention is to disclose an easy method for utilizing a brake not comprised in the drive machinery in a situation where passengers are to be freed from an elevator that has stopped due to a power failure.

The invention makes it possible to extend the safe field of application of CSW-type elevators to elevators designed for higher speeds or a greater hoisting height without having to compromise on the useful life of the ropes or the traction sheave as a consequence of a significantly improved grip between the ropes and the traction sheave. Using a simple arrangement, the invention also leads to an improvement in the operating characteristics of fast and high-rise elevators. Safe extension of the field of application is achieved by increasing the braking force applied during emergency braking and at the same time taking care that the deceleration of the elevator car is not increased excessively. In high-rise elevators, which are among the fastest elevators, the mass of the car typically equals two to two-and-a-half times the nominal load while the mass of the counterweight typically equals the mass of the car plus half the nominal load. Additional masses to be accelerated in the elevator include e.g. the mass of the ropes. When, according to the basic idea of the invention, the decelerating force generated by a braking device not comprised in the drive machine is kept at a clearly lower level than the weight of the nominal load of the elevator, harmful deceleration rates during emergency braking of the elevator are avoided.

As the braking device not comprised in the drive machine but placed at a large distance from the elevator machine room has to be released using an emergency power supply from the machine room or the release of the brake has to be effected in some other way from a distance, the emergency power supply or other emergency device used can be a device with moderate ratings, because the braking device is of a moderate size regarding its braking force and the energy required for its release and therefore also its efficiency.

Using the solution of the invention, a longer useful life of the ropes and traction sheave are achieved. The drive machine can be implemented using a solution involving no large internal stresses, thus reducing e.g. the load on the bearings. The service life of the ropes, traction sheave and bearings may even be increased to several times their usual durability. On the whole, simpler solutions regarding the machine and rope suspension can be achieved. As CSW suspension does not require any voluminous diverting pulley arrangements in the machine room, even a very large elevator will only need a moderate machine room floor area. No heavy supporting structures for diverting pulley arrangements are needed. The moderate size and weight of the machine achieved by the invention allow easier machine room lay-out and installation work. High-performance machines are often part of an elevator group of several elevators, and in this situation the advantage regarding space utilization provided by easy placeability is accentuated. The brake not comprised in the drive machine as provided by the invention can be used safely and without any major special measures in a situation where passengers are to be freed from an elevator that has stopped due to a power failure.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described by the aid of an example of its embodiments, without limiting the range of application of the invention as such, with reference to the attached drawings, wherein.

DETAILED DESCRIPTION OF THE INVENTION

Figure 1:
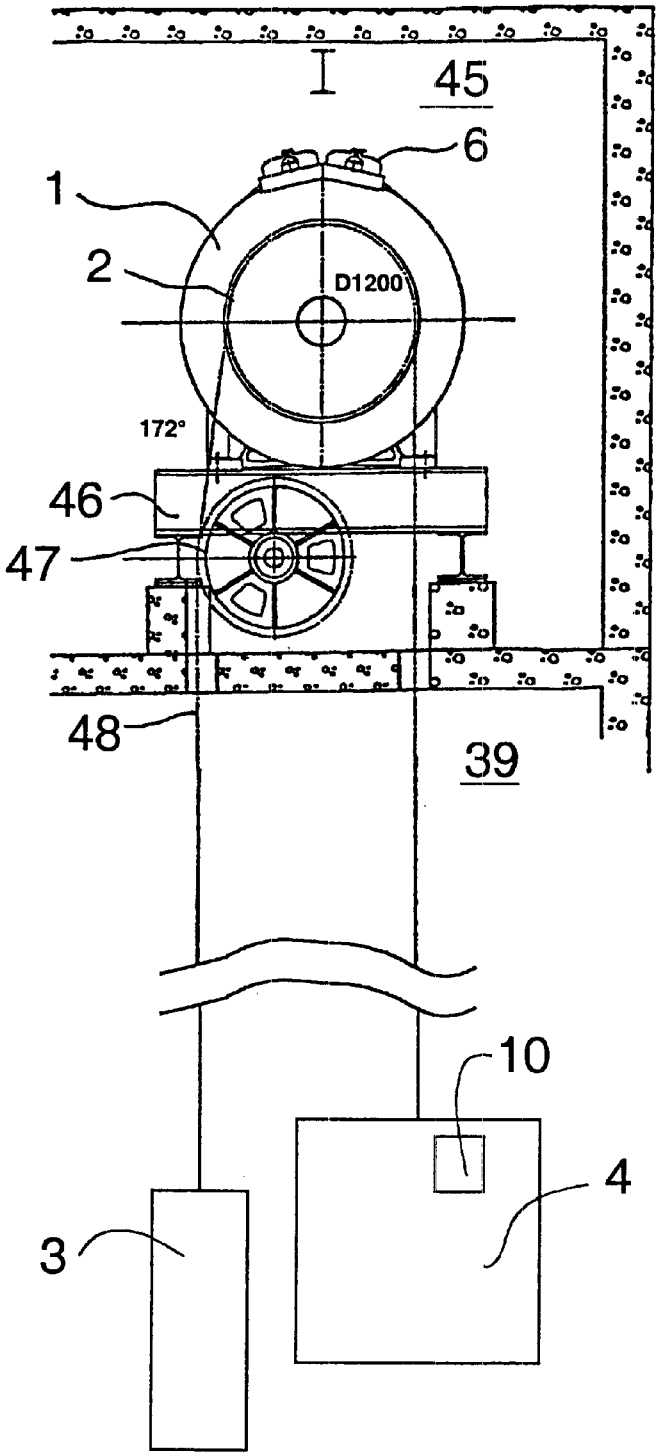
FIG. 1 illustrates the placement of a drive machine according to the invention.

FIG. 1 illustrates the placement of an elevator drive machine 1 in a machine room 45 above an elevator hoistway 39. The drive machine is placed on a mounting base 46 constructed from steel beams. The distance between the portions of the hoisting ropes 48 going to the counterweight 3 and to the elevator car 4 has been increased by placing a diverting pulley 47 so that the distance is somewhat larger than the distance corresponding to the diameter of the traction sheave 2. The brake 6 of the drive machine functions primarily as a hold brake when the elevator is standing still. A preferred method of braking an elevator is electric braking. Generally, in electric braking, even in case of power failure and emergency stop, the motor brakes regeneratively. The operating brake 6 is engaged, increasing the braking power. Thus, the traction sheave is heavily braked while the ropes, counterweight, elevator car and other masses suspended on them tend to continue their movement. If the grip between the traction sheave and the ropes is insufficient, then the rope will start slipping, and braking the traction sheave will not stop the elevator. In an elevator like that in FIG. 1, the risk of rope slip is present when the speed is relatively high or when there is a very great imbalance between the car-side and the counterweight-side parts of the system. In high-rise and fast elevators, however, the car and the counterweight are so heavy that even a 25% overload as such will not cause rope slip. At lower speeds, if the elevator is conventionally designed, the rope does not start slipping when the brakes are suddenly applied as in the case of an emergency stop. At higher speeds, when the speed is several meters per second, it is very likely that the rope will slip, especially if the undercut of the traction sheave rope grooves has been designed to produce only slight rope wear.

In practice, the invention is implemented e.g. by providing the drive machine with a brake, the drive machine comprising a traction sheave driving the hoisting ropes and, via the hoisting ropes, moving the elevator car and counterweight suspended on the ropes. In the case of an emergency stop, the brake falls down on the traction sheave to decelerate its motion. Emergency stop is activated in a manner known in itself. Emergency stop is complemented by using a braking device 10 not comprised in the drive machine. There are several alternatives as to the point of application of the braking action of the braking device not comprised in the drive machine, because it is intended to decelerate the motion of the elevator car independently of the friction between the elevator ropes and the traction sheave. The action of the braking device may be applied e.g. to the elevator ropes, to a guide rail or to an equalizing gear. A preferable solution is e.g. a forceps-like device applying a braking action to a rope, a guide rail or an equalizing gear. The braking device not comprised in the drive machine can be caused to start its braking action before the main brake of the elevator is engaged. This may result in avoiding rope slip altogether and accomplishing braking using the brakes only. On the other hand, it is possible to utilize rope slip during braking. This will distribute the heat produced by the braking action to several points. Utilizing the rope slip reduces the required braking force of the braking device not comprised in the drive machine. However, in practice the brake in the drive machine brakes first, or the brake in the drive machine and the braking device not comprised in the drive machine start braking at about the same time. Thus, the auxiliary brake complements the braking by receiving any residual force that the brake of the drive machine may not be able to absorb.

As for elevator control, the control of the brakes not comprised in the drive machine is preferably implemented by monitoring the elevator speed as well as the operational state of the brake in the elevator machine. If the brake in the elevator machine starts braking and at the same time the elevator speed is higher than a set speed, e.g. higher than 1 m/s or 1.6 m/s, then the brakes not comprised in the drive machine are applied. In this way, it is possible to avoid tripping the braking device not comprised in the drive machine.

If the braking device not comprised in the drive machine is implemented as an eddy current brake, e.g. using permanent magnets by causing the magnets to interact with the elevator guide rails, then the contribution of such a device to the deceleration is dependent on the speed. It is possible to implement a mechanical braking device gripping a guide rail or rope that will only brake when the speed exceeds a set speed. Thus, the braking device will not be tripped e.g. during servicing operation when the elevator is operated at a relatively low speed, even if the safety circuit of the elevator should be open, and the device therefore does not require separate shunting of the safety circuit. On the other hand, the braking power of an eddy current brake is insignificant at a low speed, so such a brake will not hamper servicing operation.

Figure 2:
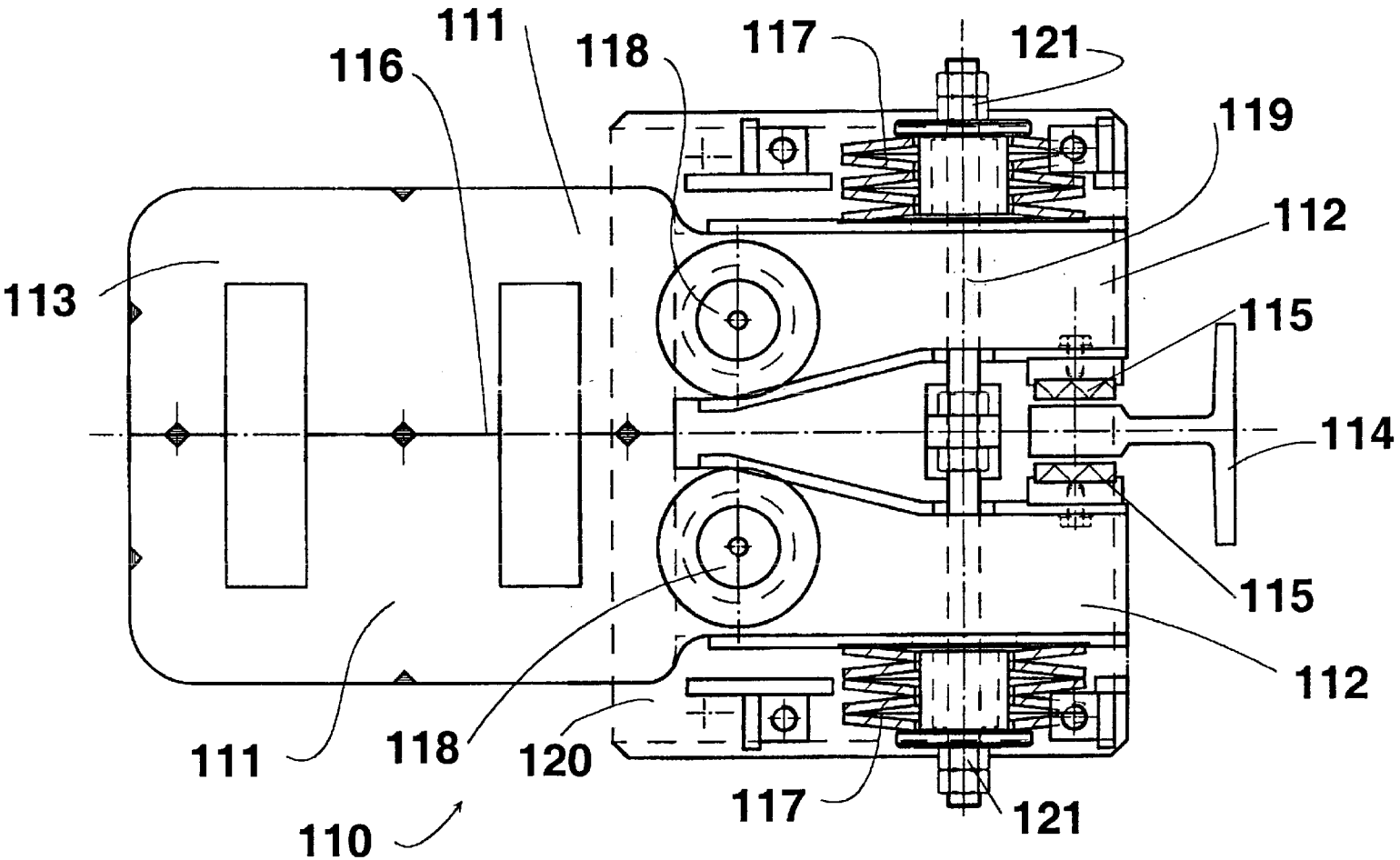
FIG. 2 presents a brake engaging a guide rail.

FIG. 2 presents a brake 110 applying a braking action to a guide rail. Such a brake may alone constitute a braking device (10) not comprised in the drive machine according to the invention. However, a preferable braking device solution is one in which two brakes 110 releasable by electromagnetic means and closeable by spring force work together as a brake pair in which each brake applies its braking force to a different guide rail. In the brake 110, the iron core 113 of the releasing winding (not shown in the figure) of the brake consists of two disk packs 111 which have extensions forming the jaws 112 of the forceps-like brake and are separated by an air gap 116 that changes as the brake is operated. The jaws 112 are provided with brake pads 115, which are pressed against the guide rail 114. The integrated iron core brake jaw combination, i.e. the disk packs ill are pivoted on pivot pins 118 located between the jaws 112 and the iron core 113 and fastened to a frame 120 supporting the brake. The braking force of the brake 110 is generated by springs 117 compressing the jaws 112, presented in the figure as disk springs. Other types of spring, e.g. spiral springs may also be used. The springs are placed around a bar 119 going through the springs 117. At least one end of the bar is provided with a thread fillet. By means of nuts 121, the springs are kept compressed between the ends of the bar 119, applying a pressure to the jaws 112. Using the nuts 121, the braking force can be adjusted within the limits imposed by the structure and the components.

Figure 3:
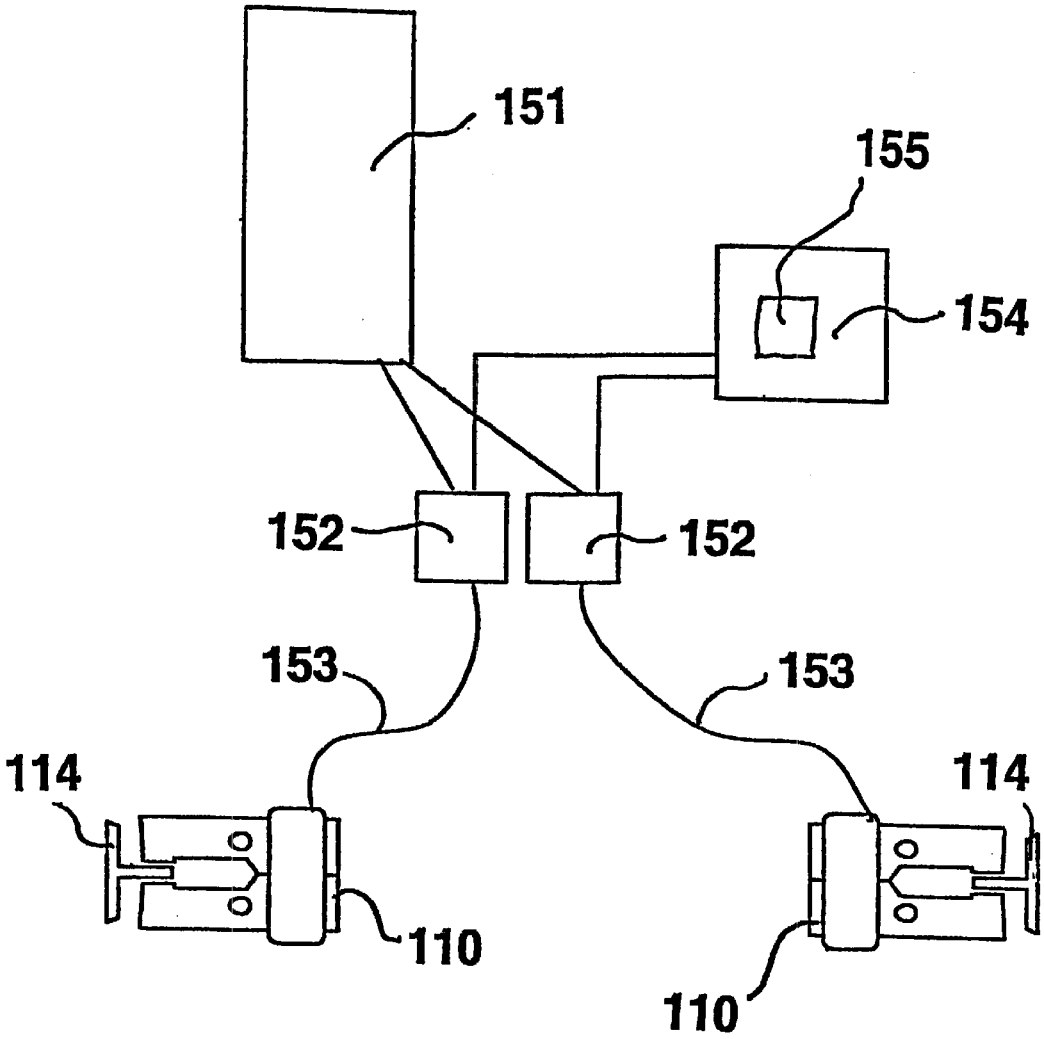
FIG. 3 illustrates the principle of an arrangement for the release of brakes not comprised in the drive machine.

FIG. 3 presents an arrangement for releasing the brakes 110 not comprised in the drive machine. Normally, the electrical and control equipment 151 of the elevator provide a supply of electricity to and operational control of modules 152 operating the brakes not comprised in the drive machine, which are mounted on the elevator car. These modules 152, which in their simplest form may be controlled switches, supply a relatively large current to the brakes 110 when the brakes are being released, and subsequently a smaller holding current. The electricity to the brakes is supplied via conductors 153 in the car cable, or by a corresponding method. To allow the brakes mounted on the elevator car to be released via control from the machine room, it is necessary to provide an electricity supply needed for releasing the brakes. In the event of a power failure, the brakes are closed to brake by gripping the guide rail while the main operating brake of the elevator brakes the rotation of the traction sheave. To enable the passengers to leave the car, these brakes need to be released and the elevator car has to be moved to the level of a nearby hoistway door. By using an emergency power supply 154 and a control unit 155 provided in conjunction with the emergency power supply or a separate control unit or control functions comprises in the electrical and control equipment 151 of the elevator, the brakes 110 engaging the guide rails 114 are caused to release their grip. The required releasing and holding current is obtained from the emergency power supply. The emergency power supply also supplies the electric power needed by the control unit used. If the elevator's own control panel 151 is used, then the normal operating functions and the supply of electricity to the elevator machine are disabled either by control functions or otherwise. Similarly, other activities consuming significant amounts of power are disabled to make sure that the limited power supply capacity of the component, e.g. battery, of the emergency power is supply used to generate or store electric power is not exceeded. After these brakes 110 not comprised in the drive machine have been released, the brake in the drive machine can be released and the elevator car can be moved to a suitable floor to free the passengers. As the brakes not comprised in the drive machine have been designed to provide a relatively low braking power, releasing the brakes does not require a very high operating power. By releasing the brakes 110 chronologically in succession, the maximum current drawn from the emergency power supply will be quite small.

It is obvious to the person skilled in the art that the embodiments of the invention are not restricted to the example described above, but that they can be varied within the scope of the following claims.

What is claimed is:

1. A method for braking a traction sheave elevator which has a drive machine with a traction sheave and a brake which acts on the traction sheave, hoisting ropes driven by the traction sheave, an elevator car and a counterweight, the elevator car and the counterweight being suspended on the hoisting ropes, the method comprising the steps of braking the elevator in case of an emergency stop by using a braking device not comprised in the drive machine, the braking device including at least one brake, action of the braking device not comprised in the drive machine being applied directly to at least one of the ropes, a guide rail and an equalizing gear of the elevator, a maximum magnitude of force decelerating the elevator car generated by the braking device not comprised in the drive machine equaling about half the weight of a nominal load of the elevator.

2. The method as defined in claim 1, wherein the force decelerating the elevator car generated by the braking device not comprised in the drive machine being of a magnitude equaling at least 30% of the weight of the nominal load and at most 50% of the weight of the nominal load.

3. The method as defined in claim 1, wherein the braking action of the braking device not comprised in the drive machine is started first and the elevator is then braked via the traction sheave.

4. The method as defined in claim 1, wherein the traction sheave is stopped and while the elevator ropes are slipping in rope grooves of the traction sheave, the elevator is braked by the braking device not comprised in the drive machine.

5. The method as defined in claim 1, wherein a contribution to deceleration produced by the braking device not comprised in the drive machine is dependent on speed.

6. The method as defined in claim 1, further comprising the step of releasing the braking device not comprised in the drive machine by an emergency power supply, the elevator car being movable upon release of the braking device without first raising the elevator car.

7. A traction sheave elevator comprising a drive machine with a traction sheave, hoisting ropes driven by the traction sheave, an elevator car and counterweight suspended on the hoisting ropes and a braking device not comprised in the drive machine for enhancing braking during emergency stopping, the braking device not comprised in the drive machine applying a braking force directly to at least one of the ropes, a guide rail and an equalizing gear of the elevator, a maximum magnitude of the force decelerating the elevator car generated by the braking device not comprised in the drive machine being equal to about half the weight of a nominal load of the elevator.

8. The traction sheave elevator as defined in claim 7, wherein the braking device not comprised in the drive machine is a forceps device applying a braking force directly to the at least one of the ropes, the guide rail and the equalizing gear of the elevator.

9. The traction sheave elevator as defined in claim 7, further comprising an emergency power supply connected to the braking device not comprised in the drive machine for supplying current needed for release of the brake whereby the braking device not comprised in the drive machine can be released in an emergency situation without first raising the elevator car.

10. An emergency power supply for a traction sheave elevator having a drive machine with a traction sheave, hoisting ropes driven by the traction sheave, an elevator car and counterweight suspended on the hoisting ropes and a braking device not comprised in the drive machine for enhancing braking during emergency stopping, the braking device not comprised in the drive machine applying a braking force directly to at least one of the ropes, a guide rail and an equalizing gear of the elevator, the emergency power supply being connected to at least the braking device not comprised in the drive machine whereby current needed for release of the braking device can be supplied in the event of power failure to thereby release at least the braking device not comprised in the drive machine.

11. The emergency power supply as defined in claim 10, wherein a maximum magnitude of the force decelerating the elevator car generated by the braking device not comprised in the drive machine is equal to about half the weight of a nominal load of the elevator and wherein the emergency power supply can maintain at least the braking device not comprised in the drive machine in an open position whereby the elevator car can be moved.

12. The emergency power supply as defined in claim 10, further comprising a brake in the drive machine and wherein the brakes in the drive machine and the braking device not in the drive machine are sequentially released.

13. The emergency power supply as defined in claim 10, wherein the emergency power supply enables release of at least the braking device not comprised in the drive machine so that the elevator car can be moved without first being raised.

* * * * *

UNITED STATES PATENT AND TRADEMARK OFFICE

CERTIFICATE OF CORRECTION

PATENT NO. : 6,631,790 B2
DATED : October 14, 2003
INVENTOR(S) : Mattlar, Seppo et al.

It is certified that error appears in the above-identified patent and that said Letters Patent is hereby corrected as shown below:

Title page,
Item [30], Foreign Priority Application Data, insert: -- FINLAND 19992048 September 23, 1999 --

Signed and Sealed this

Eighteenth Day of May, 2004

JON W. DUDAS
*Acting Director of the United States Patent and Trademark Office*